US011396444B2

(12) United States Patent
Cui et al.

(10) Patent No.: US 11,396,444 B2
(45) Date of Patent: Jul. 26, 2022

(54) FOLDABLE TRUSS BOOM SECTION, TRUSS BOOM AND CRANE

(71) Applicant: XUZHOU CONSTRUCTION MACHINERY GROUP CO., LTD., Jiangsu (CN)

(72) Inventors: Dandan Cui, Jiangsu (CN); Li Sun, Jiangsu (CN); Qinwei Yu, Jiangsu (CN); Yong Yang, Jiangsu (CN); Fahao Zhu, Jiangsu (CN)

(73) Assignee: XUZHOU CONSTRUCTION MACHINERY GROUP CO., LTD., Jiangsu (CN)

( * ) Notice: Subject to any disclaimer, the term of this patent is extended or adjusted under 35 U.S.C. 154(b) by 110 days.

(21) Appl. No.: 17/251,378

(22) PCT Filed: Jul. 3, 2019

(86) PCT No.: PCT/CN2019/094539
§ 371 (c)(1),
(2) Date: Dec. 11, 2020

(87) PCT Pub. No.: WO2020/063007
PCT Pub. Date: Apr. 2, 2020

(65) Prior Publication Data

US 2021/0253408 A1 Aug. 19, 2021

(30) Foreign Application Priority Data

Sep. 30, 2018 (CN) ..... 201811153809.2

(51) Int. Cl.
*B66C 23/68* (2006.01)

(52) U.S. Cl.
CPC ..... *B66C 23/68* (2013.01)

(58) Field of Classification Search
CPC ..... B66C 23/42; B66C 23/64; E04H 12/10; E04H 12/18; E04H 12/182; E04H 12/185; E04H 12/187
See application file for complete search history.

(56) References Cited

U.S. PATENT DOCUMENTS 4,599,832 A * 7/1986 Benton ..... E04H 12/185 52/645
4,621,742 A 11/1986 Rathi
(Continued)

FOREIGN PATENT DOCUMENTS

CN 1138005 A 12/1996
CN 102358581 A 2/2012
(Continued)

OTHER PUBLICATIONS

CN 208883356 U Machine Translation (Year: 2019).*
(Continued)

*Primary Examiner* — Michael R Mansen
*Assistant Examiner* — Juan J Campos, Jr.
(74) *Attorney, Agent, or Firm* — Pillsbury Winthrop Shaw Pittman, LLP

(57) ABSTRACT

The present disclosure relates to a foldable truss boom section, a truss boom and a crane. The foldable truss boom section includes: two chords that do not intersect with each other; at least two slideways fixedly disposed on each of the two chords, wherein each of the at least two slideways has at least two slideway fixing points; and at least two long web members connecting the two chords, wherein each of the at least two long web members has at least one sliding end which is slidable along the slideway and connected to the slideway at one of the at least two slideway fixing points, so that a cross-section state of the truss boom section is changeable.

15 Claims, 5 Drawing Sheets

(56) References Cited

U.S. PATENT DOCUMENTS

| | | | | |
|---|---|---|---|---|
| 5,085,018 | A * | 2/1992 | Kitamura | H01Q 1/1235 52/646 |
| 5,267,424 | A * | 12/1993 | Douglas | E04H 12/18 52/646 |
| 2006/0118506 | A1 | 6/2006 | Zerza et al. | |
| 2008/0173605 | A1* | 7/2008 | Willim | B66C 23/68 212/270 |
| 2013/0334159 | A1* | 12/2013 | Daas | E04C 3/08 52/646 |

FOREIGN PATENT DOCUMENTS

| | | | |
|---|---|---|---|
| CN | 103818836 | A | 5/2014 |
| CN | 208883356 | U | 5/2019 |
| DE | 2525844 | B1 | 9/1976 |
| EP | 1634846 | A2 | 3/2006 |
| WO | 0053861 | A1 | 9/2000 |

OTHER PUBLICATIONS

International Search Report (with English translation) and Written Opinion dated Oct. 12, 2109 in International Application PCT/CN2019/094539 (11 pgs ).

* cited by examiner

FOLDABLE TRUSS BOOM SECTION, TRUSS BOOM AND CRANE

CROSS REFERENCE TO RELATED APPLICATIONS

This application is a national stage application, filed under 35 U.S.C. § 371, of International Application PCT/CN2019/094539, filed on Jul. 3, 2019, which is based on and claims priority to Chinese Patent Application 201811153809.2, filed on Sep. 30, 2018, the disclosure of both which are incorporated by reference herein in its entirety their entireties.

TECHNICAL FIELD

The present disclosure relates to the field of engineering machinery, and in particular, to a foldable truss boom section, a truss boom and a crane.

BACKGROUND

The truss boom (jib) consisting of a plurality of truss boom sections is a key stress-bearing structural member during a hoisting process of the crane. Especially for a lifting performance of the long arm with a small amplitude, it is more directly affected by the performance of the boom. In order to improve the lifting performance, the truss booms in the related art may usually increase a cross-sectional area of the boom section. However, the increase in a cross-sectional area may make it extremely inconvenient to assemble/disassemble and transport the truss boom. In particular, for road transport, since the width, height and length of the transport parts are all strictly restricted, there is a constrained increase in the cross-sectional area of the truss boom section. Therefore, it has become a key issue that restricts the development of a crawler crane not only to ensure that the truss boom has a sufficient lifting performance, but also to meet the restriction of the transport regulations on the transport dimensions of the truss boom.

The truss boom sections in the related art generally meet the transport requirements by partial or complete disassembly, and need to be assembled again into a truss boom during operation, so that it consumes time and labor, and the parts are likely to be damaged by repeated assembly and disassembly, thereby affecting the operational safety of the truss boom and the crane. In addition, the truss boom section in the related art after assembly has a constant cross-sectional area in an operational state, which cannot be flexibly changed according to the operational conditions, so that there is a relatively limited application range.

SUMMARY

In view of this, the present disclosure provides a foldable truss boom section, a truss boom and a crane, which can conveniently adjust a cross-sectional area of the truss boom section. The technical effects that can be produced by the preferred technical solutions among the technical solutions provided by the present disclosure will be described in detail below.

In one aspect of the present disclosure, a foldable truss boom section is provided. The foldable truss boom section includes: two chords that do not intersect with each other; at least two slideways fixedly disposed on each of the two chords, wherein each of the at least two slideways has at least two slideway fixing points; and at least two long web members connecting the two chords; wherein each of the at least two long web members has at least one sliding end which is slidable along the slideway and connected to the slideway at one of the at least two slideway fixing points, so that a cross-section state of the truss boom section is changeable.

In some embodiments, the at least two long web members include at least two X-type long web member groups, each of which includes two long web members arranged crosswise, with a cross point as an articulation point; two adjacent X-type long web member groups in the at least two X-type long web groups are articulated with each other through a non-sliding end of the respective long web members on the two chords, so as to constitute a parallelogram support structure with four articulation points as vertexes, wherein a shape of the parallelogram support structure is changeable according to a cross-sectional state of the truss boom section.

In some embodiments, the shape of the parallelogram support structure is a diamond shape.

In some embodiments, the truss boom section further includes: a closure web member, both ends of which are connected to the slideways on the two chords at slideway fixing points respectively.

In some embodiments, the closure web member includes a telescopic sleeve configured to change a length of the closure web member according to a cross-sectional state of the truss boom section.

In some embodiments, the closure web member further includes a clamping member configured to lock the telescopic sleeve.

In some embodiments, the closure web member further includes a telescopic driving device configured to drive a telescopic action of the telescopic sleeve.

In some embodiments, the closure web member further includes a bending joint, around which the closure web member is foldable to form a predetermined bending angle according to a cross-sectional state of the truss boom section.

In some embodiments, the truss boom section further includes: at least two short web members, wherein each of the at least two short web members are detachably connected at both ends to the chord and the closure web member respectively, and form a triangular support structure surrounded by the short web member, the chord and the closure web member.

In some embodiments, each of the at least two short web members has one end articulated with one of the at least two long web members, the one end is slidably connected to the slideway, each of the at least two short web members has the other end articulated with the other short web member, the other end is connected to the closure web member, so as to enable that an angle between two short web members articulated in the at least two short web members are changeable according to a cross-sectional state of the truss boom section when the closure web member is removed.

In some embodiments, each of the at least two slideways has a slideway driving mechanism connected to a sliding end of the long web member, and configured to drive the sliding end to slide along the slideway.

In the present disclosure, a truss boom is also provided. The truss boom includes: at least two foldable truss boom sections described previously, wherein the at least two truss boom sections are sequentially connected along a length direction of the truss boom.

In some embodiments, the at least two truss boom sections have different cross-sectional states.

In some embodiments, the truss boom further includes: a transition boom section connected between two adjacent truss boom sections in different cross-sectional states.

In the present disclosure, a crane is further provided. The crane includes the truss boom described previously.

Based on the above-described technical solutions, the embodiments of the present disclosure can produce at least the following technical effects:

By providing a slideway on the chord and making a sliding end of the long web member slidable relative to the slideway, the cross-sectional state of the truss boom section may change by the long web sliding relative to the chord, so that the cross-sectional area of the truss boom may change simply and rapidly so as to adapt to different requirements in a transport state and an operational condition under the premise that the truss boom section is not disassembled.

BRIEF DESCRIPTION OF THE DRAWINGS

The drawings described herein are used to provide a further understanding of the present disclosure and constitute a part of the present application. The illustrative embodiments of the present disclosure as well as the descriptions thereof, which are used for explaining the present disclosure, do not constitute improper definitions on the present disclosure. In the accompanying drawings.

DETAILED DESCRIPTION

The content of the present disclosure and the differences between the present disclosure and the related art may be understood below with reference to the accompanying drawings and the literal content. The technical solutions of the present disclosure, including the preferred technical solutions, will be described in further detail below through the accompanying drawings and in such a manner as to list some alternative embodiments of the present disclosure.

It should be noted that any technical feature or any technical solution in present embodiment is one or more of a plurality of alternative technical features or alternative technical solutions. Since this document can be neither exhaustive in all the alternative technical features and alternative technical solutions of the present disclosure, nor convenient for emphasizing the embodiment of each technical feature as one of a plurality of alternative embodiments for the sake of concise description, those skilled in the art should know that: it is possible to replace any technical means provided by the present disclosure or combine any two or more technical means or technical features provided by the present disclosure with each other so as to obtain a new technical solution.

Any technical features and any technical solution within the present embodiment do not limit the protection scope of the present disclosure, and the protection scope of the present disclosure should include any alternative technical solution that can be contemplated by those skilled in the art with no inventive effort to be involved, and a new technical solution obtained by combining any two or more technical means or technical features provided by the present disclosure with each other.

The embodiments of the present disclosure provide a foldable truss boom section, a truss boom and a crane. The technical solutions provided by the present disclosure will be explained in more detail below in conjunction with FIGS. 1 to 12.

Figure 1:
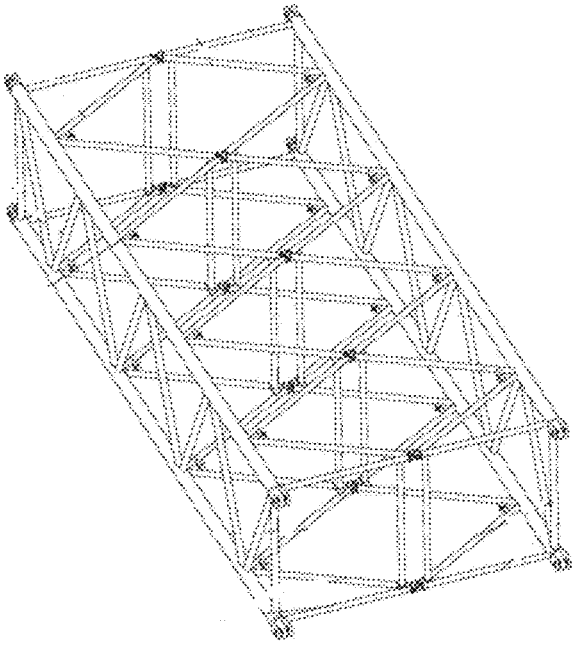
FIG. 1 is a schematic view of an operational state of the truss boom in the related art.
Figure 2:
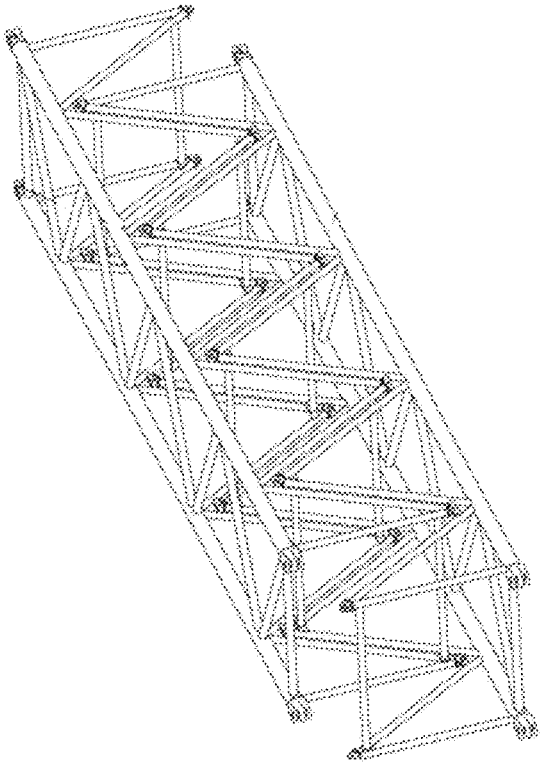
FIG. 2 is a schematic view of a transport state of the truss boom in the related art.

As shown in FIGS. 1 and 2, it is a schematic view of the truss boom in the related art in an operational state and a transport state respectively. In an operational state of the truss boom, it is necessary to assemble two truss boom sets into an integral boom section. During the transport process of the truss boom, it is necessary to disassemble an integral boom section into two truss boom sets, and place and transport them in the form of misaligned web members. The truss boom which uses such structural form not only has complicated and cumbersome operation, and key stress points are at the connection positions of the truss boom sets in an operational state, which results in a poor structural strength.

Figure 3:
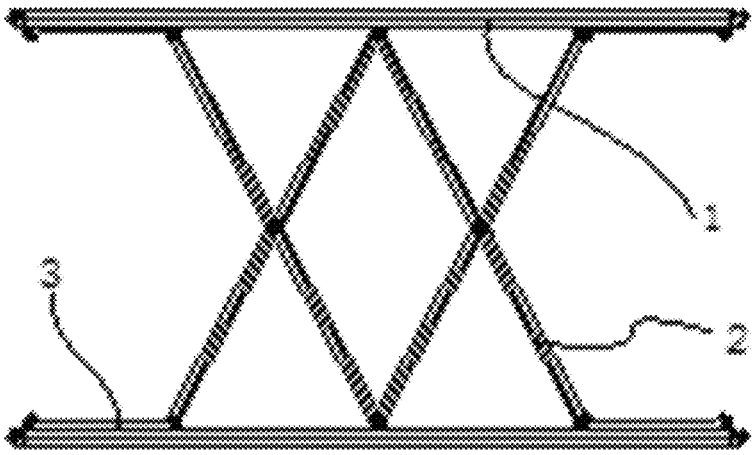
FIG. 3 is a schematic view of a cross-sectional state in one embodiment of the truss boom section of the present disclosure during operation.
Figure 4:
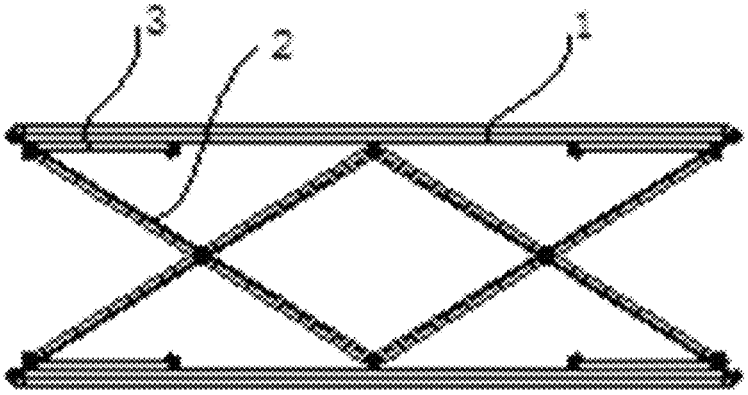
FIG. 4 is a schematic view of a cross-sectional state in one embodiment of the truss boom section of the present disclosure during transport.
Figure 5:
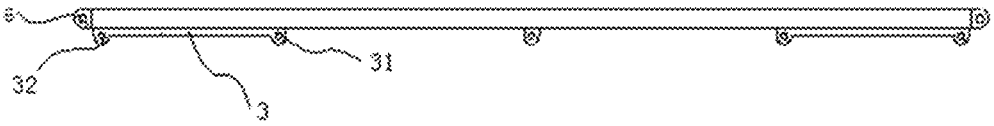
FIG. 5 is a schematic view of a chord structure in one embodiment of the truss boom section of the present disclosure.

As shown in FIGS. 3 to 5, the present disclosure provides one embodiment of a foldable truss boom section, including two chords 1 that do not intersect with each other. The chord is also referred to as a single fan structure, which is mainly formed by welding pipes and/or plates, to bear the tensile and compressive loads in the length direction of the truss boom. In addition, the two chords 1 are provided to be in such a state as not intersect with each other, for example a parallel state along a viewing angle of FIG. 3, or a non-parallel and non-intersecting state along a viewing angle of FIG. 3, so as to adapt to the connection requirements of different truss boom sections.

The truss boom section also includes at least two slideways 3 fixed to each of the two chords 1. The slideway 3 may be disposed on an inner side of the two chords 1 facing each other, or may be disposed on a lateral side of a direction of the two chords 1 facing each other. In addition, the slideway 3 may take the form of a slide rail mounted on the chord, or may also take the form of a slide groove or slide rail provided within the chord. Each slideway 3 has at least two slideway fixing points, so that the truss boom section can be at least firmly maintained in a transport cross-sectional state and an operational cross-sectional state. There may also be three or more slideway fixing points, so as to implement selecting more cross-sectional states of the truss boom section to meet the requirements of different load conditions. The cross-sectional state specifically refers to the size and shape of the area enclosed by the two chords 1 in a viewing angle of FIG. 3.

The truss boom section also includes at least two long web members 2 connecting the two chords 1, and each long web member 2 has at least one sliding end. The sliding end of the long web member 2 is slidable relative to the slideway 3, and can be selectively connected with the at least two slideway fixing points, so that the truss boom section is in different cross-sectional states. Both ends of the long web member 2 may be slidably connected to the slideway 3 to achieve a better deformation effect. In other embodiments, it is also possible to use such a manner as to be articulated at one end and slidably connected at one end, so as to ensure that the truss boom has a better bearing stability and reduce the fixing difficulty under an operational cross-sectional state. In addition, the number of long web members 2 may be alternatively to be 4 or more. When the number of the long web members 2 is 4, each long web member may use such a manner as to be articulated at one end and slidably connected at one end. When the number of long web members 2 is more than 4, for example, the number of the long web members 2 is 6, in order to ensure the deformable function of the truss boom section, two long web members 2 may use such a manner as to be articulated at one end and slidably connected at one end, while other four long web members 2 need to take such a manner as to be slidably connected at both ends. Those skilled in the art should be able to contemplate that there should be no more than one articulation point between a plurality of long web members 2 and the same chord 1. Otherwise, over-positioning will be formed, which causes that the truss boom section cannot be collapsed.

As shown in FIG. 3, the sliding end of the long web member 2 may move along a length direction of the chord 1, and the direction along which the slideway 3 is provided is also a length direction of the chord 1. When the at least two long web members 2 are connected to the chord 1 in an articulated manner, the slideway 3 may be disposed on both ends of the chord 1 to save a set length of the slideway 3 and reduce the manufacturing and maintenance cost. In other embodiments, at least two long web members 2 are all connected to the chord 1 in a slidably connected manner, and the slideway 3 may be provided to be distributed over an entire length along a length direction of the chord 1. At this time, all the long web members may slide along the slideway 3 to maximize the degree of collapsing deformation of the truss boom section.

In addition, the slideway 3 may also be provided not along a length direction of the chord 1. Those skilled in the art should be able to contemplate that the truss boom section is a three-dimensional structure. When the slideway 3 is disposed along a direction perpendicular to the length direction of the chord 1, the long web member 2 may still slide along the slideway 3 through the sliding end, and collapses or unfolds the truss boom section.

As shown in FIG. 3, the at least two long web members 2 include at least two X-type long web member groups. Each X-type long web member group includes two long web members 2 arranged crosswise with a cross point as an articulation point; two adjacent X-type long web member groups in the at least two X-type long web member groups are articulated with each other through a non-sliding ends of the two long web members 2 on the two chords 1, so as to constitute a parallelogram support structure with four articulation points as vertexes, and the parallelogram support structure can change shape according to the cross-sectional state of the truss boom section. The parallelogram support structure effectively utilizes the deformability of parallelogram, and the parallelogram support structure and the chord 1 also constitute a plurality of groups of triangular support, which reinforces the overall strength of the truss boom section.

In another embodiment, the at least two long web members 2 include at least two X-type long web member groups, and there are two long web members 2 in two adjacent X-type long web member groups located in different planes respectively. At this time, since a long web member 2 in one X-type long web member group and a long web member 2 in the other adjacent X-type long web member group does not intersect with each other, it is impossible to form such a relationship that the long web members are articulated with each other between groups. Along a viewing angle of FIG. 3, the two adjacent X-type long web member groups can also form a foldable structure similar to the parallelogram support structure. At this time, the four sides of the collapsed structure which are not coplanar, can still ensure that the truss boom section possesses a favorable foldable and deformable ability, and the triangular support structure formed by the X-type long web member group and the chord 1 has a favorable supporting capability.

Further, the parallelogram support structure is in a diamond shape, so that the truss boom section obtains a better shear and bending resistance.

As shown in FIG. 3 and FIG. 4, they are schematic views of one embodiment of the truss boom section of the present disclosure in an operational cross-sectional state and a transport cross-sectional state respectively. In the operational cross-sectional state, the sliding end of the long web member 2 is fixed to a slideway fixing point on the slideway 3 corresponding to an operational cross-sectional state. The fixing manner may use bolt connection or other feasible connection manners. At this time, there is a greater distance between the two chords 1, so that the truss boom section may obtain a larger cross-sectional area, with a reinforced bearing capacity. In the transport cross-sectional state, the sliding end of the long web member 2 is fixed to a slideway fixing point on the slideway 3 corresponding to the transport cross-sectional state. At this time, there is a smaller distance between the two chords 1, so that the size requirements for the transported objects can be met under a long-distance transport environment. Those skilled in the art should be able to contemplate that, in order to handle different load conditions or environmental conditions, the slideway 3 may also be provided with a slideway fixing point corresponding to other cross-sectional states than the foregoing operational cross-sectional state and transport cross-sectional state (for example, a multi-level operational cross-sectional state or multi-level transport cross-sectional state corresponding to a plurality of cross-sectional heights), so as to implement flexible adjustment and fixing of the cross-sectional area of the truss boom section. In particular, the slideway 3 may also use a dynamic fixing manner (e.g., a wedge pin or a buckle), so as to implement fixing of the sliding end of the long web member 2 at any position on the slideway 3 to meet the requirement of flexible adjustment.

Figure 6:
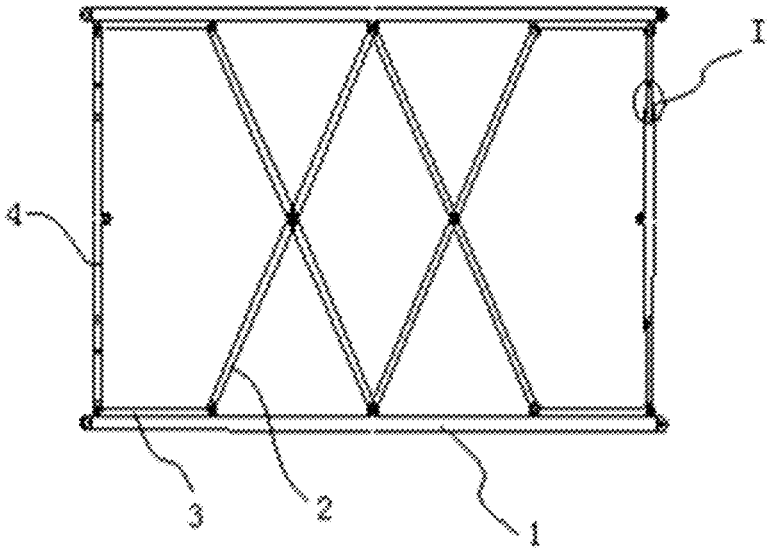
FIG. 6 is a schematic view of a cross-sectional state in another embodiment of the truss boom section of the present disclosure during operation.
Figure 7:
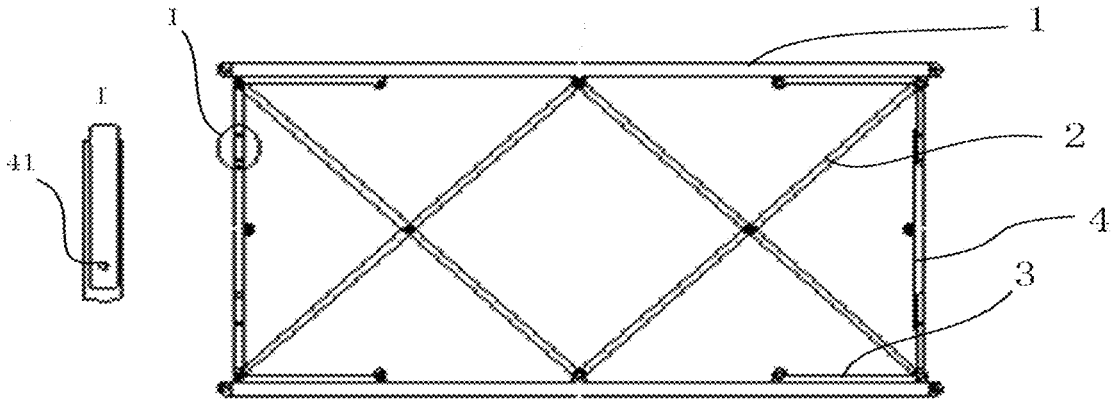
FIG. 7 is a schematic view of a manner of folding to a transport cross-sectional state in another embodiment of the truss boom section of the present disclosure.
Figure 8:
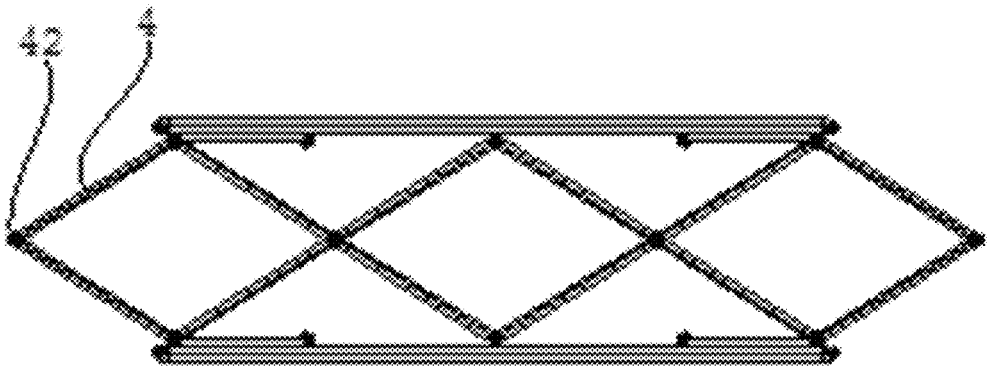
FIG. 8 is a schematic view of another manner of folding to a transport cross-sectional state in another embodiment of the truss boom section of the present disclosure.

As shown in FIGS. 6 to 8, another embodiment of the truss boom section provided by the present disclosure further includes: a closure web member 4, both ends of which are respectively connected to slideway fixing points of the slideways 3 on the two chords 1. In one aspect, the closure web member 4 is configured to support the chord 1 to bear the bending load on the truss boom, and ensure that the truss boom section does not overcome a restraint force of the slideway fixing point over the long web member to cause failure of the structure when subjected to a large bending load. On the other hand, it is possible to prevent the long web member 2 from sliding further transversely to an exterior of the truss boom section, and stabilize the structure of the truss boom section in the transport section state when the truss boom section is in the transport section state as shown in FIGS. 7 and 8.

As shown in FIG. 7, the closure web member 4 includes a telescopic sleeve. The telescopic sleeve may change the length of the closure web member 4 according to the cross-sectional state of the truss boom section. In some embodiments, the closure web member further includes a clamping member 41, which may be configured to lock the telescopic sleeve. The clamping member may be in the form of a pin shaft or a clip, and a plurality of clamping states may be realized for different cross-sectional states of the truss boom section.

In some embodiments, the cross-sectional state of the truss boom section may be determined only by the clamping member 41. For example, in an operational cross-sectional state, the clamping member 41 is in a clamped state corresponding to the operational cross-section. At this time, the closure web member 4 has a maximum length, so that there is a maximum distance between the two chords 1 connected to the closure web member 4, thereby meeting the cross-sectional area requirements in an operational cross-sectional state. In other embodiments, the clamping member 41 may also make the closure web member 4 at a shorter length, so that there is a smaller distance between the two chords 1 connected the closure web member 4, thereby obtaining a favorable transport performance.

In order to further improve the automatic telescopic capability of the telescopic sleeve, and improve the operability and deformation rate of the truss boom in collapsing and deformation, the closure web member 4 may further include a telescopic driving device capable of driving a telescopic action of the telescopic sleeve. The telescopic driving device may alternatively be an oil cylinder structure controlled by a hydraulic or electric control switch, which can more conveniently control the deformation of the truss boom. Especially for heavier truss boom sections, the telescopic driving device can improve the collapsing rate of the truss boom to a greater extent. In addition, the telescopic driving device may also implement flexible shifting of the truss boom section between different cross-sectional states in an operational state, so that the truss boom section has a wider application range.

As shown in FIG. 8, the closure web member 4 further includes a bending joint 42. The closure web member 4 may be bent around the bending joint 42 and form a predetermined bending angle according to the cross-sectional state of the truss boom section. For example, the bending joint 42 may cause the closure web member 4 to be bended toward the inner side of the truss boom section, so as to achieve a smaller cross-sectional area in the transport cross-sectional state. The bending joint 42 may also cause the closure web member 4 to be bended towards an exterior of the truss boom, so as to achieve a larger bending angle, and thus obtain a smaller distance between the two chords 1. In addition, the bending joint 42 may further include a locking device, such as a hook, for maintaining the closure web member 4 at a predetermined bending angle, so as to improve the structural stability of the truss boom section under different cross-sectional states.

Figure 9:
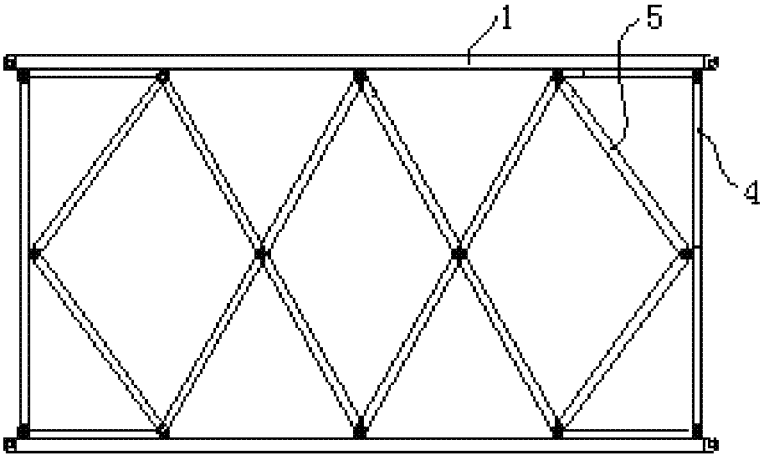
FIG. 9 is a schematic view of an operational state in still another embodiment of the truss boom section of the present disclosure.
Figure 10:
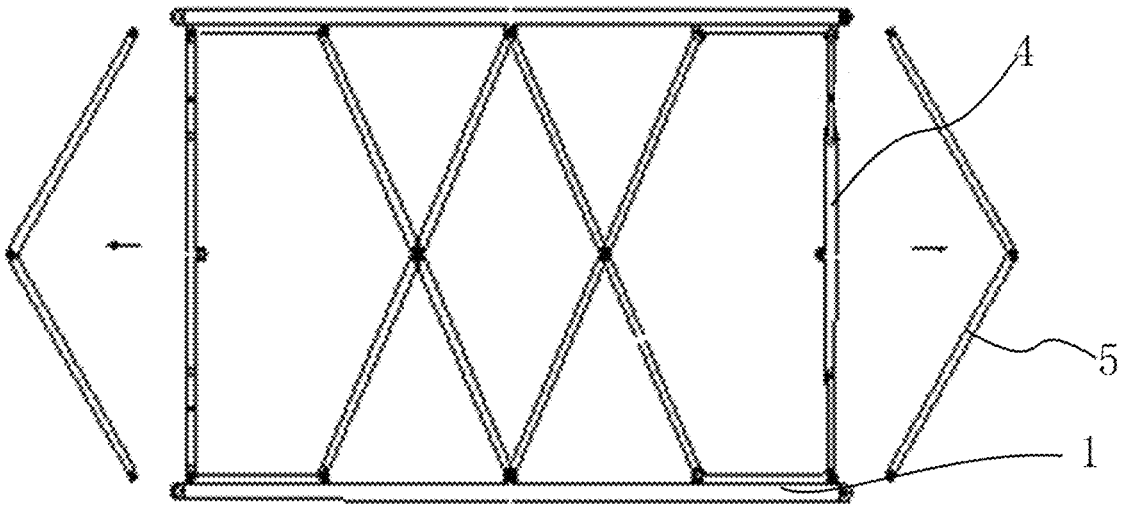
FIG. 10 is a schematic view of a manner of folding to a transport cross-sectional state in still another embodiment of the truss boom section of the present disclosure.
Figure 11:
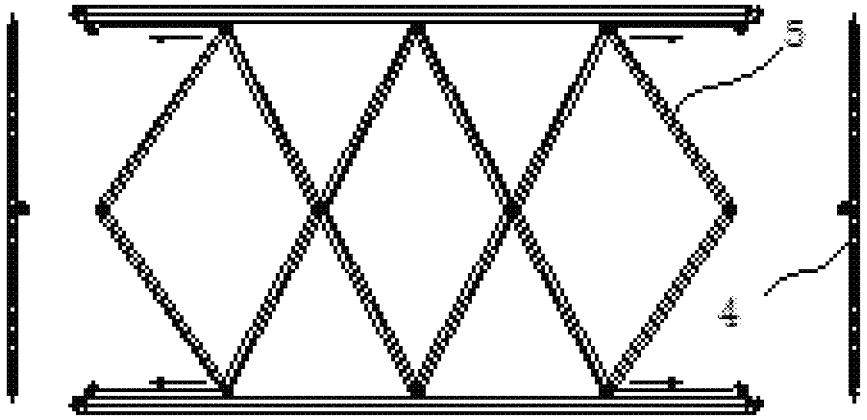
FIG. 11 is a schematic view of another manner of folding to a transport cross-sectional state in still another embodiment of the truss boom section of the present disclosure.

As shown in FIGS. 9 to 11, still another embodiment of the truss boom section provided by the present disclosure further includes at least two short web members 5. Both ends of each short web member 5 are detachably connected to the chord 1 and the closure web member 4 respectively, and form a triangular support structure surrounded by the short web member 5, the chord 1 and the closure web member 4, so as to further enhance the stability of the truss boom section.

Since the short web member 5 forms two positioning relationships with the chord 1 and the closure web member 4 respectively, when the cross-sectional state of the truss boom section is shifted, there is a need to choose to remove one positioning relationship of the short web member 5 with the chord 1 and the closure web member 4. For example, as shown in FIG. 10, the manner of removing the short web member 5 is used to release the restriction in the relative position between the chord 1 and the closure web member 4 so that the truss boom section may be collapsed. For another example, as shown in FIG. 11, it is also possible to use a manner of removing the closure web member 4 so that one end of each of the short web members 5 is slidably connected to the slideway 3, and another end is articulated with the other short web member 5 connected to the same closure web member 4. In this way, when the closure web member 4 is removed, the angle between the two short web members 5 articulated at the ends may change according to the cross-sectional state of the truss boom section.

Further, in order to better implement collapsing the truss boom section, each slideway 3 may also have a slideway drive mechanism, which is connected to the sliding end of the long web member 2 and can drive the sliding end of the long web member 2 to slide along the slideway 3. The slideway driving mechanism may be in the form of a piston, an oil cylinder, and the like, and driven by a hydraulic or electronically controlled motor to improve the deformability of the truss boom section.

Figure 12A:
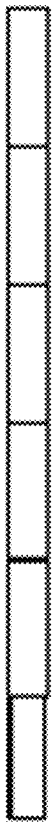
FIGS. 12 (*a*) and 12 (*b*) are structural schematic views in two embodiments of the truss boom of the present disclosure respectively.
Figure 12B:
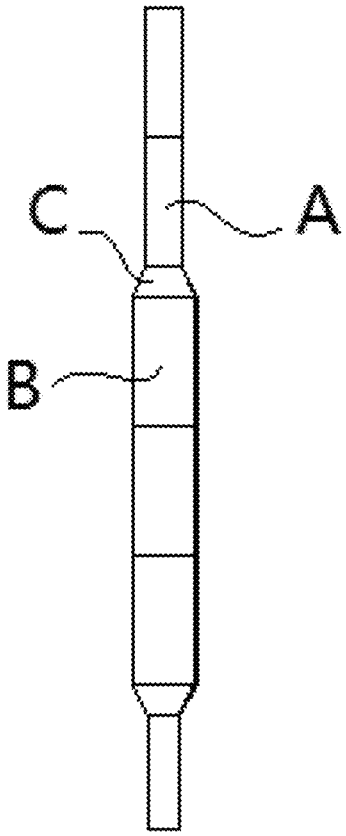

As shown in FIGS. 12 (*a*) and 12 (*b*), the present disclosure also provides a foldable truss boom including at least two truss boom sections as described above, wherein the at least two truss boom sections are sequentially connected along a length direction of the truss boom. The truss boom assembled formed by assembling at least two truss boom sections possesses a controllable cross-sectional shape, and can adapt to different operational conditions. In addition, its length can be flexibly selected, and the truss boom can also be rapidly maintained when a truss boom section fails. Specifically, due to the use of a modular design, the truss boom sections may be connected to each other through joints. Except for transition boom sections for connecting different cross-sectional states, the boom sections in the same cross-sectional state can be connected to each other in any sequence. In this way, when the truss boom fails, it is possible to achieve targeted maintenance or replacement, thereby reducing the maintenance cost and improving the maintenance efficiency.

Further, in order to enhance the overall stability of the truss boom section under the same condition, and to improve the performance and lifting height of the crane at the same tonnage under the conditions of a long boom length and a small amplitude, the at least two truss boom sections have at least two cross-sectional state. For example, the present disclosure effectively enhances the overall stability of the truss boom by providing a combination of a truss boom section having a larger cross-sectional area and a truss boom section in an original cross-sectional state.

Referring to FIG. 12 (*b*), in order to connect the truss boom sections in the above-described two cross-sectional states, the truss boom provided by the present disclosure further includes a transition boom section C for connecting two adjacent truss boom sections in different cross-sectional states, for example, a boom section A and a boom section B in FIG. 12 (*b*). The transition boom section C may use a structural form similar to the foregoing truss boom section, that is, provided as a foldable structure, so that the overall dimension of the truss boom may be changed according to the function of an operational state and environmental factors. In other embodiments, the transitional boom section may also use a non-foldable structure to obtain a simpler structure and a more stable connection effect.

The present disclosure also provides a crane including the truss boom described above. Compared with the truss boom in the related art shown in FIGS. 1-2, there is at least one of the following advantageous technical effects:

Improving the operational efficiency: compared with the existing variable cross-section solution in the industry, changing process of the entire cross-section of the present disclosure is simple and convenient, with less manual intervention, which can effectively reduce the labor intensity and improve the operational efficiency.

Reducing the investment cost of the device: since the cross-section of the boom has been fixed when the crawler crane leaves the factory, if it is intended to obtain a greater lifting performance, there is a need to purchase a crawler crane with a greater lifting performance so that the investment cost of the device is increased. The present disclosure can improve the lifting performance of the crane at a small operational radius by only replacing some intermediate booms without changing other structures of the device, and at the same time, there is only a small cost needed to invest in such replacement.

Modular design and convenient maintenance: the present disclosure which uses a modular design, divides the integral boom into a plurality of detachable modules, thereby facilitating later maintenance.

Solving the problem that the boom having a large cross-section does not meet the traffic transport regulations: the present disclosure can reduce the cross-sectional dimension of the boom during transport, so that the dimension of the boom meets the requirements of the traffic transport regulations.

At the same time, if the present disclosure described above discloses or involves parts or structural members that are fixedly connected to each other, unless otherwise stated, a fixed connection may be understood as: a detachable fixed connection (for example, using bolt or screw connection), or a non-detachable fixed connection (for example riveting and welding). Of course, the mutual fixed connection may also be replaced by an integrated structure (for example manufactured by integral forming using a casting process) (except that it is apparently impossible to use an integral forming process).

In addition, the meanings of the terms for representing the positional relationship or shape applied in any of the technical solutions disclosed in the present disclosure disclosed above, include states or shapes approximate, similar or close thereto unless otherwise stated. Any component provided by the present disclosure may be formed by assembling a plurality of separate constituent parts, or may be a separate component manufactured by an integral forming process.

In the description of the present disclosure, if the terms "center", "transverse", "longitudinal", "front", "rear", "left", "right", "vertical", "horizontal", "top", "bottom", "within", "outside" are used, the azimuth or positional relations indicated by the terms described above, which are based on the azimuth or positional relations illustrated by the drawings, are only for facilitating description of the present disclosure and simplifying the description, rather than indicating or implying that the device, mechanism, member or element referred thereto has to present a particular azimuth, and be constructed and operated in a particular azimuth, so that it cannot be understood as limiting the protection scope of the present disclosure.

Finally, it should be explained that: the aforementioned embodiments are only configured to describe the technical solution of the present disclosure rather than limiting the same; although detailed explanations are made to the present disclosure by referring to preferred embodiments, a common technical person in the art should understand that: it is still possible to make amendments to the embodiments of the present disclosure or make equivalent replacements to part of the technical features; without departing from the spirit and scope of the present disclosure, they should all be covered in the scope of the technical solution for which protection is sought in the present disclosure.

What is claimed is:

1. A foldable truss boom section comprising:

two chords that do not intersect with each other;

at least two slideways fixedly disposed on each of the two chords, wherein each of the at least two slideways has at least two slideway fixing points; and at least two long web members connecting the two chords, wherein each of the at least two long web members has at least one sliding end which is slidable along the slideway and connected to the slideway at one of the at least two slideway fixing points, so that a cross-section state of the truss boom section is changeable.

2. The truss boom section according to claim 1, wherein the at least two long web members comprise at least two X-type long web member groups, each of which comprises two long web members arranged crosswise, with a cross point as an articulation point; two adjacent X-type long web member groups in the at least two X-type long web member groups are articulated with each other through a non-sliding end of the respective long web members on the two chords, so as to constitute a parallelogram support structure with four articulation points as vertexes, wherein a shape of the parallelogram support structure is changeable according to a cross-sectional state of the truss boom section.

3. The truss boom section according to claim 2, wherein the shape of the parallelogram support structure is a diamond shape.

4. The truss boom section according to claim 1, further comprising:

a closure web member, both ends of which are connected to the slideways on the two chords at slideway fixing points respectively.

5. The truss boom section according to claim 4, wherein the closure web member comprises a telescopic sleeve configured to change a length of the closure web member according to a cross-sectional state of the truss boom section.

6. The truss boom section according to claim 5, wherein the closure web member further comprises a clamping member configured to lock the telescopic sleeve.

7. The truss boom section according to claim 5, wherein the closure web member further comprises a telescopic driving device configured to drive a telescopic action of the telescopic sleeve.

8. The truss boom according to claim 4, wherein the closure web member further comprises a bending joint, around which the closure web member is foldable to form a predetermined bending angle according to a cross-sectional state of the truss boom section.

9. The truss boom section according to claim 4, further comprising:

at least two short web members, wherein each of the at least two short web members are detachably connected at both ends to the chord and the closure web member respectively, and form a triangular support structure surrounded by the short web member, the chord and the closure web member.

10. The truss boom section according to claim 9, wherein each of the at least two short web members has one end articulated with one of the at least two long web members, the one end is slidably connected to the slideway, each of the at least two short web members has the other end articulated with the other short web member the other end is connected to the closure web member, so as to enable that an angle between two short web members articulated in the at least two short web members are changeable according to a cross-sectional state of the truss boom section when the closure web member removed.

11. The truss boom section according to claim 1, wherein each of the at least two slideways has a slideway driving mechanism connected to a sliding end of the long web member, and configured to drive the sliding end to slide along the slideway.

12. A truss boom comprising:

at least two foldable truss boom sections according to claim 1, wherein the at least two truss boom sections are sequentially connected along a length direction of the truss boom.

13. The truss boom according to claim 12, wherein the at least two truss boom sections have different cross-sectional states.

14. The truss boom according to claim 13, further comprising:

a transition boom section connected between two adjacent truss boom sections in different cross-sectional states.

15. A crane comprising the truss boom according to claim 12.

* * * * *